US006732871B1

(12) United States Patent
Flores

(10) Patent No.: US 6,732,871 B1
(45) Date of Patent: May 11, 2004

(54) CARGO TRANSPORT AND HANDLING DEVICE

(76) Inventor: Neil R. Flores, 9424 Bradner Dr., Austin, TX (US) 78748

( * ) Notice: Subject to any disclaimer, the term of this patent is extended or adjusted under 35 U.S.C. 154(b) by 47 days.

(21) Appl. No.: 09/660,845

(22) Filed: Sep. 13, 2000

Related U.S. Application Data

(60) Provisional application No. 60/153,875, filed on Sep. 14, 1999.

(51) Int. Cl.[7] ..... B66C 23/44

(52) U.S. Cl. ..... 212/180; 212/344; 212/901

(58) Field of Search ..... 212/901, 180; 414/606, 607, 785

(56) References Cited

U.S. PATENT DOCUMENTS

| | | | | | |
|---|---|---|---|---|---|
| 3,643,825 | A | * | 2/1972 | Zane | 214/512 |
| 3,757,484 | A | * | 9/1973 | Williamson et al. | 52/749 |
| 4,030,294 | A | * | 6/1977 | Ishida | 60/407 |
| 4,310,198 | A | * | 1/1982 | Destree | 299/39 |
| 4,571,139 | A | * | 2/1986 | Moseley et al. | 414/347 |
| 4,618,306 | A | * | 10/1986 | Dorsch | 414/420 |
| 4,666,004 | A | | 5/1987 | Raz | 177/139 |
| 4,714,393 | A | * | 12/1987 | Betts | 414/10 |
| 5,105,947 | A | | 4/1992 | Wise | 206/519 |
| 5,188,247 | A | * | 2/1993 | Jastrow | 212/140 |
| 5,226,558 | A | | 7/1993 | Whitney et al. | 110/571 |
| 5,383,758 | A | * | 1/1995 | Patrick | 414/680 |
| 5,516,254 | A | * | 5/1996 | Gessler | 414/607 |
| 5,692,872 | A | * | 12/1997 | Raben | 414/607 |
| 5,769,595 | A | | 6/1998 | Pearce et al. | 414/661 |
| 5,791,261 | A | | 8/1998 | John et al. | 108/56.3 |
| 5,794,782 | A | | 8/1998 | Ascik | 206/600 |
| 5,915,673 | A | * | 6/1999 | Kazerooni | 254/270 |
| 5,931,633 | A | * | 8/1999 | Weggelaar | 414/626 |
| 6,024,529 | A | * | 2/2000 | Kristensen | 414/607 |
| 6,042,329 | A | | 3/2000 | Marquez et al. | 414/607 |
| 6,168,367 | B1 | * | 1/2001 | Robinson | 414/785 |

* cited by examiner

*Primary Examiner*—Thomas J. Brahan
(74) *Attorney, Agent, or Firm*—Chalker Flores, LLP; Edwin S. Flores; Daniel J. Chalker

(57) ABSTRACT

An apparatus is disclosed for handling cargo that includes a motorized electric pallet truck (12) to which a tower (30) having two or more legs (32) is attached, the tower (30) includes a transverse member (34) connected to the two or more legs (32), and at least one mast (36) that extends from the transverse member (34) opposite the two or more legs (32), the mast (36) includes a chamber therein, at least one mechanical arm (40) is operably attached to the mast (36) and includes at least one pneumatically operated device (44) having lifting capability and an electric pump (50) is electrically connected to the electric power supply of the pallet truck (12) and provides pneumatic pressure to the interior of the tower (30).

16 Claims, 2 Drawing Sheets

CARGO TRANSPORT AND HANDLING DEVICE

This application claims the benefit of provisional application No. 60/153,875 filed Sep. 14, 1999.

TECHNICAL FIELD OF THE INVENTION

The present invention relates in general to the field of object handling, and more particularly, to an apparatus and method for handling and moving large, heavy or bulky objects using a mounted pneumatic mechanical arm attached by a pressurized tower to a pallet jack.

BACKGROUND OF THE INVENTION

Without limiting the scope of the invention, its background is described in connection with a bobbin handling system in which the tower provides a mast for operations but also pneumatic pressure for the handling system be used to control, as an example.

Manually operated forklift devices are often used to unload the contents of palleted items from a wide variety of sources in a large number of industries. To address the needs of industry for the rapid, mobile movement of items that are too large or heavy to carry, and to reduce the possibility of injury, large motorized forklift vehicles have been developed to move these items.

One example of a fork lift for use in moving large or bulky items includes a mast that can tilt to pick up items such as pallets from the floor and raise them to heights above six feet. One problem with these motorized forklifts is that they are costly, bulky and heavy and are difficult to use within the tight confines of a factory or assembly plant. Furthermore, these large forklift-type vehicles, in some states, require specialized training and a license. Consequently, the typical way to move items that are not beyond the weight-lifting capabilities of one or more individuals is manually.

SUMMARY OF THE INVENTION

It has been found, however, that available apparatus and methods for handling large, bulky or cumbersome objects are unable to meet the space constraints of the modern day factory. Furthermore, a significant problem of current systems is that they are often too large and have to great a lifting capacity at the expense of ease of use, price and maintenance costs.

Therefore, a need has arisen for a system and apparatus that can be used in a confined space, that does not require specialized training to use, and that is capable of unloading somewhat heavy, bulky or cumbersome items, such as, e.g., nylon bobbins from the pallet on which they are transported. The system and apparatus must be easy to operate and capable of use by a single individual. The system and apparatus should also More particularly, the present invention, includes a motorized electric pallet truck to which a tower is affixed. The tower includes two or more legs that attach to the pallet truck, a transverse member connecting the two or more legs, and at least one hollow mast extends from the transverse member opposite the two or more legs. A chamber that is capable of withstanding pressure is defined within the hollow portions of the tower. At least one mechanical arm that is operably attached to the at least one mast, the mechanical arm including at least one pneumatically operated device having lifting capability. An electric pump provides pneumatic pressure to the chamber defined within the interior or hollow portions of the tower. The pump may be located on the transverse member and may be electrically connected to the electric power supply of the pallet truck. The pump may further include a pressure regulator/filter and a one-way "check" valve.

This invention provides an inexpensive, simply constructed, easily usable and transportable apparatus and method for unloading and transporting the palleted contents from the a wide variety of sources, thereby eliminating the need to manually unload such freight with a recognized labor and cost savings to the user. Savings are also realized as the apparatus is rugged and contains no moving parts that may wear that are not easily accessible to maintenance personnel. The apparatus is also customizable for use handling a wide variety of cargo, regardless of weight or bulk.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and do not delimit the scope of the invention.

Figure 1:
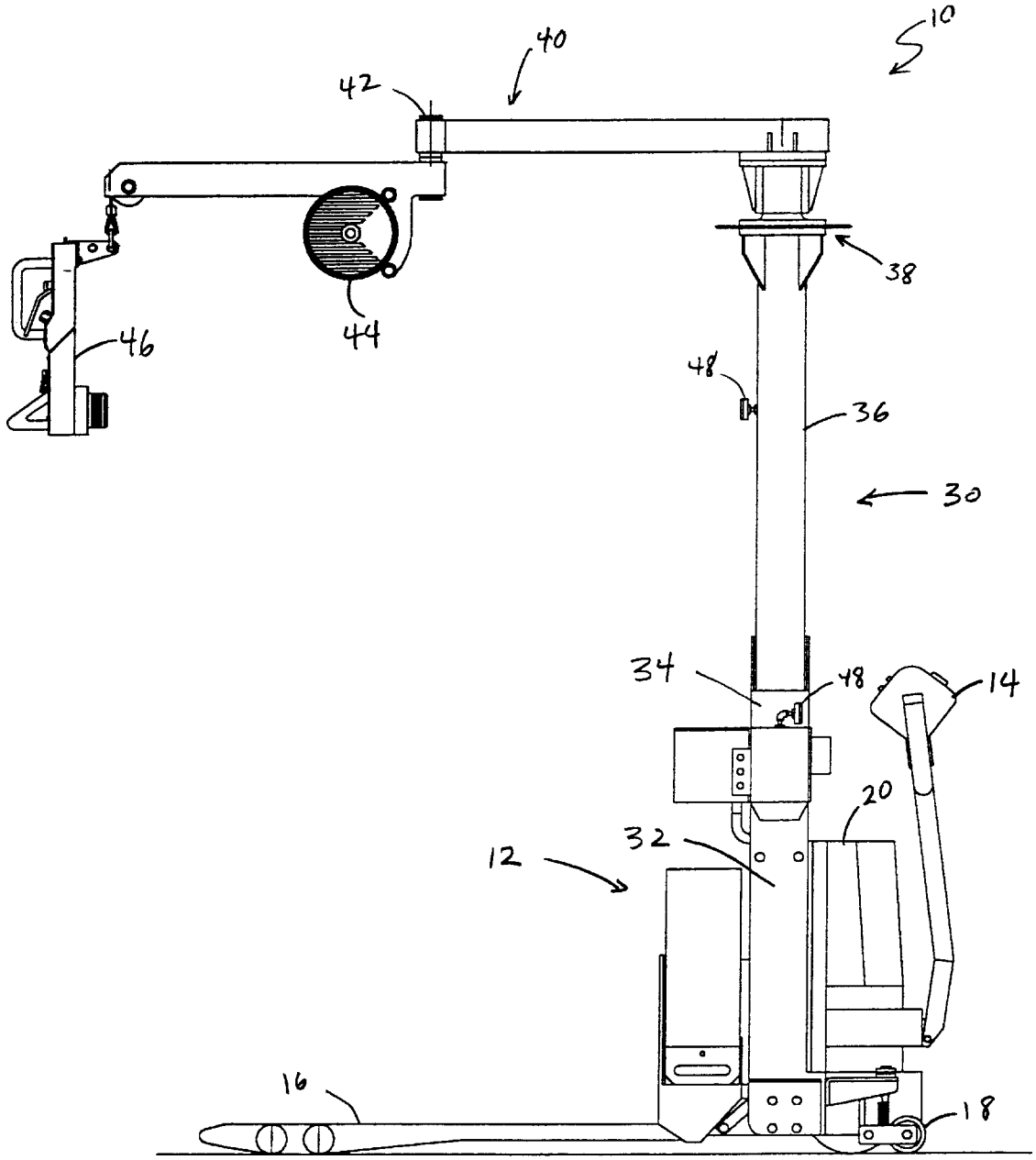
FIG. 1 is a side-view of one embodiment of the apparatus with a single jointed mechanical arm.

The general features of an apparatus for handling cargo in accordance with the present invention is shown in side view in FIG. 1, and is generally designated 10. A pallet truck or jack 12 is shown and will be an electric freight handling forklift apparatus and may include a "walk/steer" handle 14 illustrated as adapted for use in when unloading and transporting a stack of pallets. The cargo will generally be placed on the lower lift linkage assembly 16. One such pallet truck 12 may be a Barrett WRP Series Walkie/Rider Pallet Truck (Marengo, Ill., U.S.A.). The pallet truck 12 may also include a balanced drive system that will generally prevents an unbalanced torque condition while the operator turns the pallet truck 12. In addition to the standard casters with which the Barrett WRP or other like pallet trucks 12 are provided, additional casters 18 may be provided and are generally positioned away from the midline of the pallet truck 12, thereby increasing the lateral stability of the cargo handling device disclosed herein, particularly when operating with a load as described hereinbelow. The casters 18 may be spring-loaded to provide for increased stability and contact when operating on uneven surfaces. The operational capabilities of the pallet truck 12 will vary depending on the weight of the objects being handled, and may include pallet trucks having operational weight capacities of, e.g., 2000, 4000 or even 6000 lbs.

The pallet truck 12 has attached thereto a tower 30, which generally extends vertically from the drive guard assembly 20 that encases the motor, transmission and power supply (not depicted) of the pallet truck 12. The tower 30 includes, as depicted, two legs 32, a transverse member 34 and a mast 36, ending in a flange 38. A mechanical arm 40 is attached to the flange 38 and is depicted as extending over the lower lift linkage assembly 16. Also depicted are pressure gauges 48 that measure the pressure inside the transverse member 34, the mast 36, or both as described in operation hereinbelow.

One such mechanical arm 40 for use with the present invention may be a Series 600 Manipulator Arm System (Zimmerman, Madison Heights, Mich., U.S.A.). Some of the features for selection of a mechanical arm 40 for use with the present invention include: 360 degree rotation capability, single or double jointed lateral movement 42, a pneumatic balancer 44, single or double rails, a large variety of handling devices 46 and ease or use during manual operation. The length of the mechanical arm 40 may also varied depending on the weight and operational range required for operation, and may be. e.g., 4, 6, 8 or 10 feet.

One such handling device 46 for use with the present invention is disclosed by Kulhavy in U.S. Pat. No. 5,522,581, issued Jun. 4, 1996, the relevant portions of which are incorporated herein by reference. The handling device includes a balancing hoist and material handling system that includes a pneumatically operated balancing hoist. The hoist includes a housing with a chamber and an inlet for communicating with the chamber. A piston is positioned in the housing. A rotating cable drum moves longitudinally within the housing with the piston. The rotating cable drum contains one or more longitudinal openings. When the rotating cable drum is moved longitudinally, rod mechanisms slidably and longitudinally engage the cable drum through one or more longitudinal openings, causing a flywheel located at one end of the housing to rotate. When the rotation of the cable drum exceeds a predetermined speed, one or more brake shoes mounted to the flywheel may move outwardly to contact a braking surface located on the interior of the housing to stop the rotation of the cable drum. The balancing hoist may be used with the present invention as part of a material handling system, for example, when attaching to moving a spool of nylon or other heavy or bulky object that might potentially harm a user.

One such item that may be particularly cumbersome due to both its weight and size is a bobbin. Bobbins, generally, come packaged vertically and must be positioned in a horizontal position in the spooling machinery. One such bobbin handling system for use with the present invention may be purchased from Zimmerman (Madison Heights, Mich. U.S.A.). One such apparatus for handling bobbins is disclosed by Van Orsdale, Jr. in U.S. Pat. No. 4,226,567, issued Oct. 7, 1980, the relevant portions of which are incorporated herein by reference. The bobbin handler includes handle having parallel linkages pivotally mounted thereon and connected to a fluid-operated ram. A bobbin-engaging unit is carried at the ends of the linkages and engages the bobbin internally. After engagement, the linkages are manipulated to transfer the bobbin to another location with the weight of the bobbin and mechanism being offset by the fluid-operated cylinder. The handler is designed to be attached to a portable bobbin buggy so that both can then be pushed as a unit to move the buggy to a desired location from which the bobbins are transferred to a creel or rack, for example.

Figure 2:
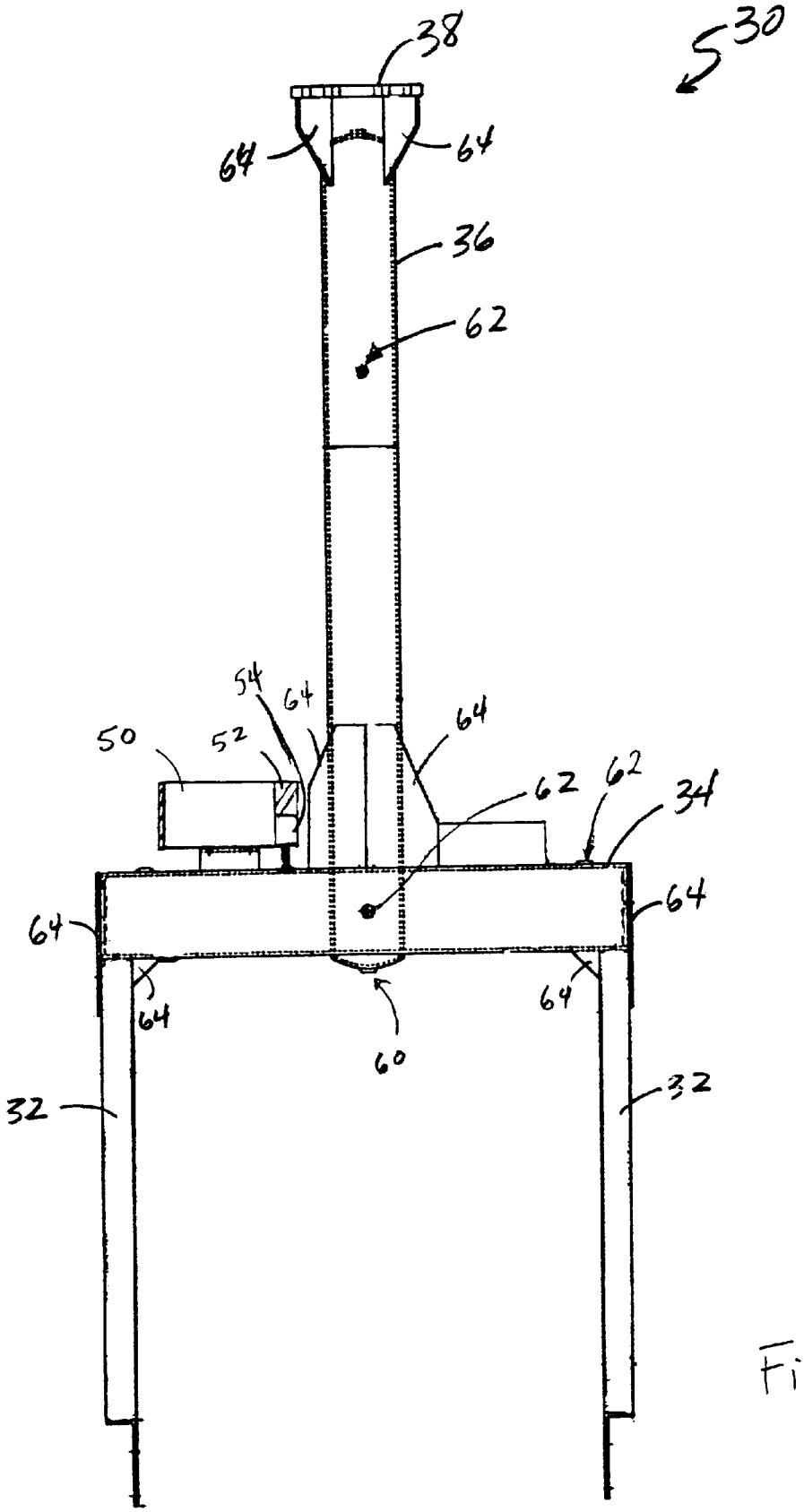
FIG. 2 is a front view of the tower of the apparatus of FIG. 1 in isolation.

FIG. 2 provides a more detailed view of the features of the tower 30. As noted in reference to FIG. 1, the tower 30 includes two legs 32, a transverse member 34 and a mast 36, ending in a flange 38. The transverse member 34, the mast 36 or both will generally be of hollow construction of a material, such as steel or aluminum, that is durable and that is capable of supporting not only the mechanical arm 40 but any cargo that may be placed on the mechanical arm. The hollow portion of these parts of the tower 30 are sealed so as to withstand pressures of greater than 100 p.s.i., in addition to the strength to support the mechanical arm 40 and any cargo.

In one embodiment, the hollow portions of the transverse member 34 and the mast 36 are in communication such that the pressure in both chambers is about the same. A pump 50 may be connected to the power supply of the pallet truck 12 and should be capable of providing pneumatic pressure to the interior of the hollow chamber or chambers that form part of the tower 30. As noted already, the tower 30 will generally be constructed of a material, such as steel or aluminum. When using steel, the tower 30 and in particular the hollow portion or portions of the tower 30 that define a chamber may be sealed by simple welding, providing for ease of construction, reduced cost and durability. Alternatively, pressure bearing plates and seals may be used to seal the chamber that is included within the tower 30. Yet another alternative is provide a separate chamber that fits or is formed within the hollow portions of the transverse member, the mast or even the legs, so long as sufficient pressure and pneumatic capacity is provided to the pneumatic operated portions of the mechanical arm 40.

In one embodiment of the invention, the hollowed-out portions of the tower 30 will be designed to have a portion that is lower than the rest of the chamber and through which water condensation, dirt or oil may be removed from the interior of the chamber following operation. For example, the mast 38 may be designed to traverse the transverse member 34 and provide the location for a valve 60. The valve 60 will generally provide a seal for the interior of the hollow chamber of the tower 30 and be operable to release any fluids from within the chamber, as well as, chamber pressure. A liquid release tube (not depicted) may be connected to the valve 60 and be positioned and of sufficient length to travel from the lowest point in the chamber, along one of the legs 32, to a position close to the floor for release.

The pump 50 is connected to the power supply of the pallet truck 12 for power, and provides pneumatic pressure to the interior of the transverse member 34 and/or the mast 36 such that it serves as a reservoir for the pneumatic requirements of the mechanical arm 40. In particular, the balancer 44 is a pneumatic balancer whose operation is controlled by the user via controls on, e.g., the handling device 46. Between the pump 50 and the interior of the tower 30 it has been found useful to provide a combination pressure regulator and filter 52 and a one-way or "check" valve 54 to prevent pressure back-up. The position of the pump 50 on the transverse member 34 has been found to be particularly useful, as alternative configurations were found to decrease the operational life of the unit.

A series of openings may also be located in communication with the interior chamber of the tower 30 to provide information to the user, to remove captured humidity and other liquid contaminants, as well as to provide for a pressure probe that controls the operation of the pump 50. One such pressure sensor 62 may be a mechanical pressure sensor that is electrically connected to a relay or "contacter", such as those knownas contact/dry relays used for engine or automobile starters. One such contact/dry relay is a 40 Amp/12 Volt starter relay. This particular type of contact/dry relay has been found to increase operational durability when compared to solid-state relays. An indicator light (not depicted) may also be provided to inform the user when the pump 50 is in operation.

The tower 30 is depicted including a number of reinforcements 64 that serve to increase the strength of the tower 30 at potential pressure points during operation. The strength, number and position of these reinforcements 64 will depend on the stress placed on the parts of the present invention that are under mechanical stress, as will be known to those of skill in the art. It is noted, however, that caution teaches that the welding, reinforcements and other attachment points should generally be designed to tolerance limits that significantly exceed the normal operational conditions to which these joints will be exposed.

In operation, the apparatus of the present invention is described, by means of example, in use for the capture, movement and installation of a nylon bobbins. Other uses will be apparent from the invention as described and as will be known to those of skill in the art in light of the present disclosure. One such example is the automotive industry in which heavy and bulk items are often handled.

The user will generally drive the apparatus disclosed herein to a pallet containing a number of nylon bobbins or spools using the controls of the pallet truck 12. Next, the user addresses the nylon bobbin by lowering the handling device 46 to the bobbin and captures the bobbin using controls that are located on the handling device and that operate the balancer 44 of the mechanical arm 40. Pneumatic pressure for the balancer 44 is drawn from the interior chamber of the tower 30, which is provided by the pump 50. It is at this point that the pressure gauge 48 that faces the user is particularly useful as he or she is able to determine that the balancer is being provided with sufficient pressure to capture the bobbin.

Next, the user directs the balancer 44, through the controls of the handling device 46, to lift the bobbin. As the bobbins are usually shipped vertically, but are inserted into operational machinery horizontally, one handling device for use with the invention will have a rotational center that permits capturing the bobbin vertically and is then allowed to rotate into a horizontal position for delivery into operational machinery. One the bobbin has been captured, it will generally be lowered onto the pallet truck 12 for transport through the factory or plant. A safety device that may be particularly useful is a control device that prevents the mechanical arm from rotating, whether holding a cargo or not, as the operator drives the pallet truck to deliver the cargo. As the operator travels to deliver the bobbin, the second gauge 48 provides the driver with information about the status of the pressure within the tower 30.

To deliver the bobbin to the operational machinery, the user will next take advantage of the rotational capabilities of the mechanical arm 40 to deliver the bobbin. When operating the mechanical arm to deliver a bobbin to machinery that is at a location that must take advantage of the reach of the mechanical arm, a second set of casters that are lateral from the casters generally provided with pallet trucks have been found to be of use. The second set of lateral casters, often spring-loaded, provide for increased lateral stability when the center of gravity of the present invention is shifted by the weight of the bobbin or a combination of the bobbin and any addition lateral pressure provided by the user.

While this invention has been described in reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An apparatus for handling cargo, said apparatus comprising:

a motorized pallet truck; and a tower disposed atop the pallet truck comprising:

two or more legs that attach to the pallet truck, a transverse member comprising a first pressure chamber connecting the two or more legs;

and at least one mast that extends from the transverse member opposite the two or more legs, wherein the mast comprises a second pressure chamber therein;

at least one mechanical arm that is operably attached to the at least one mast, the mechanical arm including at least one pneumatically operated device, wherein the pneumatically operated device is connected to the pressure chamber in the mast; and an electric pump connected to provide pneumatic pressure to the pressure chamber within the mast.

2. The apparatus of claim 1, wherein the first and second pressure chambers are connected.

3. The apparatus of claim 1, wherein said pressure chamber within the mast is further defined as comprising a valve that is positioned to release any liquid that builds up within the pressure chamber.

4. The apparatus of claim 1, wherein the mechanical arm is defined further as comprising a double acting joint to provide 360 degree rotation.

5. The apparatus of claim 1, wherein the mechanical arm is defined as further comprising a hand-held handling device that controls the at least one pneumatically operated device.

6. The apparatus of claim 1, wherein the pneumatically operated device is further defined as a balancer.

7. The apparatus of claim 1, wherein the pneumatically operated device and the pallet truck further comprise controls, which are located on the pallet truck.

8. The apparatus of claim 1, wherein the pump is further defined as comprising a pressure regulator, a filter and a check valve.

9. An apparatus for handling cargo, said apparatus comprising:

a motorized, functional electric pallet truck comprising an electric power supply;

a tower positioned atop the pallet truck comprising:

two or more legs that attach to the pallet truck;

a transverse member comprising first pressure chamber connecting the two or more legs;

at least one mast connected to and extending from the transverse member opposite the two or more legs, wherein the mast comprises a second pressure chamber;

at least one mechanical arm that is operably attached to the at least one mast, the mechanical arm comprising at least one pressure-operated device having lift capability;

at least one pressure-operated device mounted on the mechanical arm and connected to the first or second pressure chamber; and an electric pump connected electrically to the electric power supply of the pallet truck, wherein the electric pump is mounted on the tower and is connected to the first or second pressure chamber and provides pressure thereto.

10. The apparatus of claim 9, wherein the pressure chambers of the transverse member and the mast define a single pressure chamber.

11. The apparatus of claim 9, wherein one of the pressure chamber is further defined as comprising a valve that is positioned to release any liquid that builds up within the chamber.

12. The apparatus of claim 9, wherein the mechanical arm comprises a double acting joint to provide 360 degree rotation to the mechanical arm.

13. The apparatus of claim 9, wherein the mechanical arm is defined as further comprising a handling device that controls the pressure-operated device.

14. The apparatus of claim 9, wherein a control for the pressure-operated device and a control for the pallet truck are attached to the pallet truck.

15. The apparatus of claim 9, wherein the electric pneumatic pump is further defined as comprising a pressure regulator, a filter and a check valve.

16. A tower for use with a pallet truck and a mechanical arm, the tower comprising:

two or more legs for attachment to the pallet truck;

a transverse member disposed between and connecting the legs, wherein the transverse member comprises a pressure chamber therein;

a mast positioned opposite the two or more legs and generally perpendicular and connected to the transverse member, wherein the mast provides the sole support for the mechanical arm; and a flange positioned atop the mast, wherein the flange provides a point of attachment for the mechanical arm, wherein pressure within the pressure chamber is used to provide pressure to a hand-held pressure operated device connected to the chamber in the transverse member.

* * * * *